United States Patent [19]

Huguenin

[11] 4,006,587

[45] Feb. 8, 1977

[54] WRIST-WATCH WITH WRISTLET END SECURED TO TOP OF CASE

[75] Inventor: Freddy Huguenin, Lausanne, Switzerland

[73] Assignee: Ebauches Electroniques S.A., Neuchatel, Switzerland

[22] Filed: Dec. 24, 1975

[21] Appl. No.: 644,195

[30] Foreign Application Priority Data

Jan. 10, 1975 Switzerland ..... 274/75

[52] U.S. Cl. ..... 58/88 R; 58/23 R; 58/50 R; 58/127 R; 224/4 E; 224/4 F; 224/28 W

[51] Int. Cl.² ..... A44C 5/14; A45C 11/10; G04C 3/00

[58] Field of Search ..... 58/23 R, 50 R, 53, 57, 58/88 R, 103, 127 R, 88 G; 224/4 A, 4 C, 4 D, 4 E, 4 F, 28 W

[56] References Cited

UNITED STATES PATENTS

| | | | |
|---|---|---|---|
| 3,576,099 | 4/1971 | Walton | 58/23 R X |
| 3,585,744 | 6/1971 | Arnone | 224/28 W X |
| 3,700,148 | 10/1972 | Lanvin | 224/4 D X |
| 3,768,247 | 10/1973 | Fujita | 58/23 R |
| 3,786,626 | 1/1974 | Hurt | 58/88 R |
| 3,823,551 | 7/1974 | Riehl | 58/23 R |
| 3,841,083 | 10/1974 | Bergey | 58/50 R |
| 3,911,664 | 10/1975 | Haber | 58/23 R |
| 3,942,316 | 3/1976 | Van Haaften | 58/23 R |

*Primary Examiner*—Stanley J. Witkowski
*Attorney, Agent, or Firm*—St. Onge Mayers Steward & Reens

[57] ABSTRACT

This wrist-watch is characterized by the fact that the display device is arranged on one of the lateral sides of the watch casing, thus leaving its upper surface free, the wristlet being secured to the casing by one of its ends and being applied, by its opposite end, onto the said upper surface of the casing to which it is removably secured.

8 Claims, 8 Drawing Figures

WRIST-WATCH WITH WRISTLET END SECURED TO TOP OF CASE

The drawing shows, by way of example, one embodiment of the object of the invention.

Figure 1:
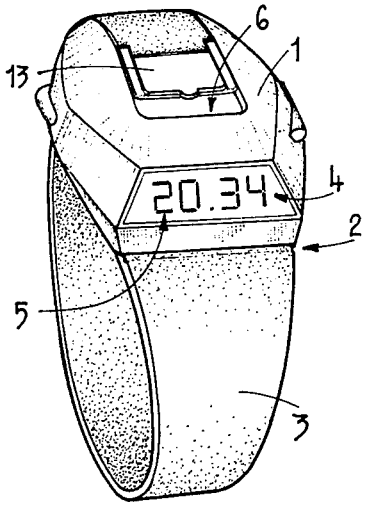
FIG. 1 is a perspective view of a wrist-watch.
Figure 2:
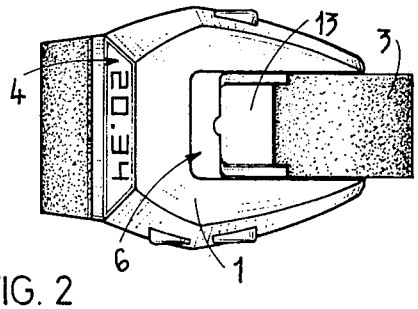
FIG. 2 is a plane view thereof.
Figure 3:
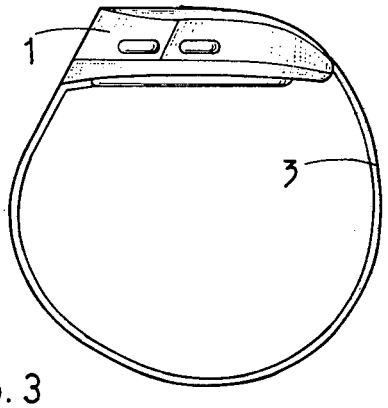
FIG. 3 is an elevational view of this watch.

As shown in FIGS. 1–3 the wrist-watch comprises a casing 1 to which is secured, at 2, a flexible strap 3 constituting the wristlet. This watch, which is electronic, is provided, on one of its lateral faces, with a window 4 through which appear the indications 5 of the digital hour display. It results from this arrangement that the upper face of the watch is free of any display device. This upper face is provided with a recess 6 in which are engaged the free end of the strap 3 and the portion of the clasp which is rigid therewith.

Figure 4:
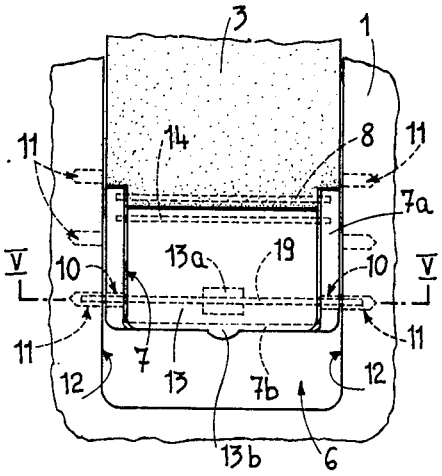
FIG. 4 is a plan view of the clasp, at a larger scale, in position of closing.
Figure 5:
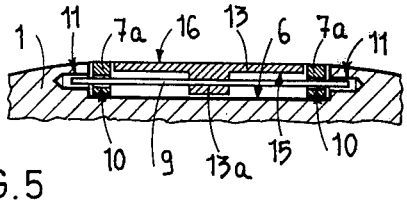
FIG. 5 is a sectional view along line V—V of FIG. 4.

As shown in FIGS. 4 and 5 this portion of the clasp comprises a stirrup shaped element 7, articulated to the strap 3 by means of a small bar 8 disposed between the ends of its arms, designated by 7*a*, and which passes through the end of the strap.

The arms 7*a* of the stirrup shaped element 7 are traversed, in the vicinity of its transversal portion, designated by 7*b*, by an elastic metallic wire 9 which passes through holes 10 provided in the same arms 7*a* and which goes beyond these arms, on both sides thereof. The ends of the wire 9 are engaged in one or the other of several pairs of blend holes 11 provided in the longitudinal walls, designated by 12, of the recess 6. These several holes 11 are disposed opposite to each other, by pairs, and permit, according to which pair into which are engaged the ends of the wire 9, to vary the length of the wristlet when the clasp is closed.

The clasp comprises moreover a small control plate 13 articulated, by means of a transversal small bar 14 which traverses it in the vicinity of its rear end, to the two arms 7*a* of the stirrup shaped element 7. This small plate 13 is provided, protruding on its inner face, designated by 15, with an embossment 13*a* through which is provided a transversal hole in which is forced the wire 9. This hole of the embossment 13*a* is situated in the alignment of the holes 10 of the arms 7*a* when the clasp is in its rest position, the small plate 13 bearing then on the transversal portion 7*b* of the stirrup shaped element 7. It is to be noted that the upper face of the transversal portion 7*b* is situated slightly back with respect to the plane of the upper faces of the arms 7*a* so that, when the small plate 13 is at rest, bearing on this portion 7*b*, its outer face, designated by 16, be situated substantially in the plane of the upper face of the arms 7*a*. The front edge of the small plate 13 is provided with a lip 13*b* permitting to lift this small plate with the nail.

Figure 7:
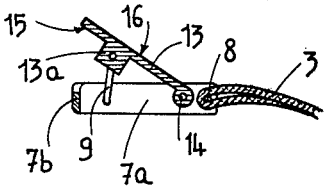
FIG. 7 is a sectional view along line VII—VII of FIG. 6.
Figure 6:
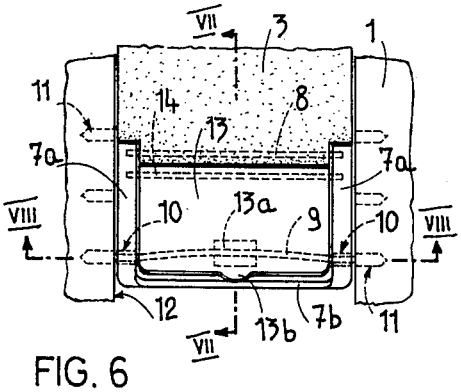
FIG. 6 is a plan view of a part of the clasp, at the scale of FIG. 4, in the open position.
Figure 8:
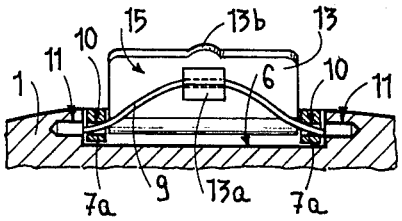
FIG. 8 is a sectional view along line VIII—VIII of FIG. 6.

When the small plate 13 is lifted, as represented in FIGS. 6 to 8, the elastic wire 9 is bound, that brings its ends to slide in the arms 7*a* and to go out from the holes 11 provided in the walls of the recess 6 of the casing 1. This operation of the small plate 13 thus permits the opening or the closing of the clasp.

In the example represented, one of the portions of the clasp is constituted by the casing of the watch, but this portion can be replaced by any element having the shape of a fork between the arms of which will be engaged the opposite end of the strap or the second part of this strap as well as the portion of the clasp which is rigid therewith.

What I claim is:

1. Wrist-watch having a digital hour display, characterized by the fact that the display device is arranged on one of the lateral faces of the watch-casing, thus leaving its upper face free, the wristlet being secured to the casing by one of its ends and being applied, by its opposite end, onto the said upper face of the casing to which it is secured removably.

2. Wrist-watch as claimed in claim 1, characterized by the fact that the hour display device is situated on the side of the casing along which is secured one of the ends of the wristlet.

3. Wrist-watch as claimed in claim 1, characterized by the fact that the upper face of the casing is provided with an elongated recess opening laterally on the face of the casing opposite to the secured one of the ends of the wristlet, the opposite end of the wristlet engaging in the said recess in which it is removably secured.

4. Wrist-watch as claimed in claim 3, characterized by the fact that the end of the wristlet which is removably secured to the casing carries a stirrup shaped element secured to the wristlet by the end of its arms, which are traversed, transversally, in the vicinity of the transversal portion of the stirrup, by an elastically deformable wire, the ends of which, at rest, go beyond the said arms on both sides thereof, for engaging transversal holes provided in the longitudinal walls of the said recess of the watch-casing, the stirrup carrying moreover a control element articulated between its arms by one of its ends and which is traversed, at its opposite end, by the said elastic wire, in such a way that, while lifting the said control element, one produces the bending of this wire the ends of which slide then in the arms of the stirrup that permits to engage them into the transversal holes and to remove them thereout.

5. Wrist-watch as claimed in claim 4, characterized by the fact that each longitudinal wall of the recess of the casing is provided with several transversal holes, the holes of the two walls being opposite to each other, by pairs, so as to permit to modify the length of the wristlet while engaging the ends of the elastic wire into one or the other of the said pairs of holes.

6. Wrist-watch as claimed in claim 4, characterized by the fact that the elastic wire is forced into the control element so as not to be able to move with respect to this element when the control element is operated.

7. Wrist-watch as claimed in claim 4, characterized by the fact that the control element is constituted by a small plate located between the arms of the stirrup, substantially at the level of the upper face of these arms, articulated on these arms in the vicinity of their end and which is provided, on its inner face, with a protrusion in which is provided a transversal hole situated, at rest, in the axis of the holes of the arms of the stirrup which are traversed by the elastic wire.

8. Wrist-watch as claimed in claim 7, characterized by the fact that the upper face of the transversal portion of the stirrup shaped element is situated back with respect to the upper face of its arms so that, the small plate bearing on the said upper face of the transversal portion, at rest, it remains substantially in the plane of the upper face of the said arms.

* * * * *

UNITED STATES PATENT OFFICE

CERTIFICATE OF CORRECTION

Patent No. 4,006,587 Dated February 8, 1977

Inventor(s) Freddy Huguenin

It is certified that error appears in the above-identified patent and that said Letters Patent are hereby corrected as shown below:

On the cover page, the name of the Assignee should read -- Ebauches S.A. -- .

Signed and Sealed this

Thirty-first Day of May 1977

[SEAL]

*Attest:*

RUTH C. MASON
*Attesting Officer*

C. MARSHALL DANN
*Commissioner of Patents and Trademarks*